US012108787B2

(12) United States Patent
Sebastian et al.

(10) Patent No.: US 12,108,787 B2
(45) Date of Patent: Oct. 8, 2024

(54) AEROSOL FORMER FOR BIODEGRADABLE HEAT-NOT-BURN AND E-CIGARETTES WITH RELATED SYSTEM AND METHOD

(71) Applicants: IP CONCEPTS LLC, Perry, GA (US); HOKORD LIMITED, Hong Kong (CN)

(72) Inventors: Andries Don Sebastian, Perry, GA (US); Yurii Lypskyi, Zhytomyr (UA)

(73) Assignees: IP CONCEPTS LLC, Perry, GA (US); HOKORD LIMITED, Hong Kong (CN)

( * ) Notice: Subject to any disclaimer, the term of this patent is extended or adjusted under 35 U.S.C. 154(b) by 0 days.

(21) Appl. No.: 18/381,340

(22) Filed: Oct. 18, 2023

(65) Prior Publication Data

US 2024/0122234 A1 Apr. 18, 2024

Related U.S. Application Data

(60) Provisional application No. 63/417,200, filed on Oct. 18, 2022.

(51) Int. Cl.
*A24D 1/20* (2020.01)
*A24B 15/167* (2020.01)
(Continued)

(52) U.S. Cl.
CPC ..... *A24D 1/20* (2020.01); *A24B 15/167* (2016.11); *A24B 15/303* (2013.01); *A24D 1/02* (2013.01);
(Continued)

(58) Field of Classification Search
CPC ..... A24D 1/20; A24D 1/02; A24B 15/167; A24B 15/303
See application file for complete search history.

(56) References Cited

U.S. PATENT DOCUMENTS

2021/0068449 A1* 3/2021 Lord ..... A24F 40/30
2021/0321655 A1 10/2021 Sebastian et al.
(Continued)

FOREIGN PATENT DOCUMENTS

EP 3915404 A1 12/2021

OTHER PUBLICATIONS

Related PCT Pat. App. Ser. No. PCT/US2023/035388, filed on Oct. 18, 2023, Pub. App. No. WO2024086210, published on Apr. 25, 2024, entitled, Aerosol Former for Biodegradable Heat-Not-Burn and E-Cigarettes With Related System and Method, International Search Report and Written Opinion of the ISA (EPO), transmitted on Mar. 18, 2024, 14Pages.

*Primary Examiner* — Christopher M Rodd
*Assistant Examiner* — Jennifer A Kessie
(74) *Attorney, Agent, or Firm* — Smith Tempel; Steven P. Wigmore

(57) ABSTRACT

An aerosol former for heat-not-burn and biodegradable e-cigarette includes a sectional member wrapped by a paper material. At least one section is a botanical section connected to more than one e-liquid section when used for heat-not-burn cigarettes, and without the botanical section when used for e-cigarettes. The e-liquid sections include a heated segment and a vapor permeable liquid-flow-inhibiting thermal barrier. Each of the heated segments may include a sandwich structure. The structure may include a porous sponge layer made from a cellulose fiber based non-woven material which is installed inside a base frame aluminum foil structure. Each of the vapor permeable liquid-flow-inhibiting thermal barriers may have a first layer made of a hard non-porous hydrophobic non-woven fiber, and a second outside, external layer made from a hydrophobic cellulose fiber. The second layer forms a limiting surface barrier for the first layer.

10 Claims, 7 Drawing Sheets

(51) Int. Cl.

| | |
|---|---|
| ***A24B 15/30*** | (2006.01) |
| ***A24D 1/02*** | (2006.01) |
| ***A24D 1/04*** | (2006.01) |
| ***A24D 1/18*** | (2006.01) |
| ***A24D 3/06*** | (2006.01) |
| ***A24D 3/17*** | (2020.01) |

(52) U.S. Cl.
CPC ..... *A24D 1/04* (2013.01); *A24D 1/18* (2013.01); *A24D 3/068* (2013.01); *A24D 3/17* (2020.01)

(56) References Cited

U.S. PATENT DOCUMENTS

| | | | |
|---|---|---|---|
| 2022/0110368 | A1 | 4/2022 | Jang et al. |
| 2022/0192252 | A1 | 6/2022 | Besso et al. |

* cited by examiner

AEROSOL FORMER FOR BIODEGRADABLE HEAT-NOT-BURN AND E-CIGARETTES WITH RELATED SYSTEM AND METHOD

BACKGROUND OF THE INVENTION

Field of the Invention

The present disclosure relates to aerosol forming systems and methods of usage thereof for yielding aerosol precursor compositions in inhalable form. More particularly, the present disclosure relates to aerosol source members containing e-liquid material sections and botanical material sections forming an aerosol delivery product utilizing electrically generated heat to heat aerosol precursor compositions, preferably without significant combustion, to provide an inhalable substance in the form of an aerosol for human consumption. This disclosure also pertains to aerosol formers without solid botanicals as in E-cigarettes in which aerosol precursor compositions are only used to form the inhalable aerosol without using metallic surfaces that are currently used in most E-cigarettes.

Prior Art

Many smoking products have been proposed for use as improvements upon, or alternatives to, smoking products based upon combusting botanical material (for example tobacco and similar) for use. Some example alternatives have included devices wherein a solid or liquid fuel is combusted to transfer heat to tobacco or wherein a chemical reaction is used to provide such heat source. Additional example alternatives use electrical energy to heat tobacco and/or other aerosol generating substrate materials, such as described in U.S. patent nos. U.S. Ser. No. 11/083,215B2, U.S. Ser. No. 11/076,642B1 and published patent application no. US20210321655A1. Other known alternative heating methods include use of a carbonaceous heat source for heating aerosol precursors loaded on paper and/or fabric substrates within a cigarette are described in U.S. Pat. Nos. 5,348,027, 5,247,947, 5,203,355, 5,019,122, 5,019,122, 5,183,062, and 5,099,861.

According to the known prior art, there are e-liquid/tobacco heating hybrid devices, also known as electronic tobacco hybrid devices, that heat tobacco without burning and are also called Heat-Not-Burn cigarettes. These hybrid devices usually contain an e-liquid source (which may or may not contain nicotine) which is vaporized by heating to produce an inhalable vapor or aerosol. The device additionally contains a solid aerosolizable material (which may or may not contain a tobacco material) and components of this material are entrained in the inhalable vapor or aerosol to produce the inhaled medium.

Some known aerosol formers include more than one heater, with each heater configured to heat different parts of the aerosolizable material of the aerosol former. This then allows various parts of the aerosolizable material to be heated at different times and temperatures so as to provide longevity of aerosol formation over the use lifetime. The heating and device and smoking products in cooperation form a system for providing an aerosol former product which is heated according to a method based on programmable instructions.

Based on the programmable instructions, a temperature profile of the e-liquid sections of the aerosol former during heating is different from a temperature profile of the botanical section of the aerosol former. By controlling the temperature of the e-liquid and the botanical sections over time such that the temperature profiles of the sections are different, it is possible to control the puff profile of the aerosol during use.

However, when aerosol formers are heated to form the aerosol harmful chemical components are often generated from the e-liquid and/or the botanical source because of series positioning of botanical product sections which leads to overheating. When hybrid devices containing tobacco are heated to temperatures exceeding 150 Deg C. tobacco specific toxic chemicals may be formed, the extent of their formation dependent upon the heating time and the temperature. These chemicals are known as Harmful and Potentially Harmful Constituents (HPHC) by the United States the Food and Drug Administration (FDA). Also the sectional design of the aerosol formers leads to a structural fragility which can lead to aerosol former destruction within the heating device. Other problems relate to: (a) environmental pollution by residues of disposable e-cigarette type aerosol formers that are typically made with non-biodegradable plastics and batteries; (b) metal contamination of the aerosol due to the use of metallic surfaces to heat the aerosol precursor; and (c) repeated heating of the same e-liquid over and over again during the use period contribute to the formation of undesirable chemical degradation of products.

The method and system for providing aerosol formers according to the present embodiment can solve the problems of the prior art described above.

SUMMARY OF THE INVENTION

The present disclosure provides a system, and a method for providing an aerosol generating smoking product with lower harmful chemical components than current market heat-not-burn and disposable E-cigarette products for producing an inhalable aerosol from an aerosol-generating substrate using a heating device. Additionally, the invention allows for making a new kind of single use and disposable E-cigarette that is mostly biodegradable.

The aerosol former for producing an inhalable aerosol, may comprise: a sectional member wrapped by a thin paper material, wherein at least one section is a botanical section connected to an e-liquid section. The e-liquid section consists of heated segments and non-heated segments. The non-heated segment of the e-liquid section functions as a vapor permeable and liquid-flow-inhibiting thermal barrier. These are specially designed spacing structures as described below. Each of the heated segments of the e-liquid section comprises a sandwich structure that includes a porous fibrous sponge layer installed inside a base frame aluminum foil structure. The porous fibrous sponge layer may be positioned between two stiffener barriers. The stiffener barrier shaped as a labyrinth sealing may form a limiting surface barrier to prevent contact between the sponge layer and the adjoining airgap thereby preventing e-liquid leakage.

According to one possible embodiment of the invention, the porous fibrous sponge layer installed inside the base frame aluminum foil cylinder comprises a cellulose fiber with a high burn temperature. The porous medium of the sponge layer is designed as a pleated paper or non-woven fiber matrix predominantly made of cellulose fiber. The sponge layer may be designed with a high porosity for high e-liquid holding capacity and may have a hollow center with a wall thickness of at least 2.00 mm. The thickness may be adjusted so as to be able to contain sufficient e-liquid within the fiber layer.

The porous fibrous sponge layer can be filled with an e-liquid composition comprising glycerin, water, propylene glycol, synthetic or tobacco derived nicotine, nicotine salts, cannabinoid, and one or more flavoring compounds loaded onto a porous medium of the sponge layer.

In some embodiments the labyrinth sealing may be omitted.

According to one of the embodiments, the e-liquid section comprises at least two separate heated segments wherein each of the heated segment volume is designed for at least three puffs.

Each of the spacing segments may comprise a base frame hard non-porous inherently hydrophobic fibrous structure forming a limiting surface barrier. The inherently hydrophobic fiber is made of chemically modified regenerated cellulose such as Olea fiber available from Kelheim Fibers GmbH of Bavaria, Germany. The spacing segment forms a vapor permeable liquid-flow-inhibiting thermal barrier between the heated segments. The thickness of the limiting surface barrier is usually at least 2 mm.

In one of the possible embodiments, the e-liquid section and at least one tobacco section may be connected in series with a cooling segment and a filter segment of a mouthpiece section.

Several e-liquid sections and at least one botanical section and the mouthpiece section are wrapped with paper or polymeric fiber wrap that is of sufficient thickness to maintain structural integrity of the aerosol former.

The heated segments of the e-liquid section and at least one botanical section are usually heated separately.

According to one preferred embodiment of the invention, the botanical section is connected to a mouthpiece section comprising the filter segment and the cooling segment of the aerosol former.

A system for an aerosol former according to the present invention may include:

- a sectional member wrapped by a thin paper material installed into a heating electronic device,
- the heating electronic device may comprise a body part and a cover part connected to each other by a slider coupling device. The cover part may be locked by a slider lock in a top part.

The body part and the cover part form a longitudinal cavity from the top to the bottom part for the aerosol former product installation. As described above, the aerosol former product may include at least one botanical section connected to the e-liquid section. The e-liquid sections may include heated segments and spacing segments. An inner surface of the longitudinal cavity may have ring heating components connected to the power source and a control unit. The ring heating components are adjusted to the botanical section and to each heated segment of the e-liquid section. Each of the heating components is configured to heat a heated segment successively. The control unit is configured to provide heating duration related to a preset number of puffs for each e-liquid section. The liquid holding capacity of each e-liquid section is related to the porosity of the sponge and a set of heating rate and heating duration.

According to another exemplary embodiment of the system, the ring heating components are positioned in a close contact with the botanical section and each heated segment of the e-liquid sections. The heating components may comprise nichrome or an iron-chromium-aluminum (FeCrAl) alloy (sold under the brand of KANTHAL™ as of this writing), or a mixture thereof. The heating components may comprise half-ring/semi-ring shaped plates located on the body part surface and the cover part surface within the longitudinal cavity area.

According to the present invention, a method for providing an aerosol former may include the steps of:

- forming a system for the aerosol former product that includes the sectional member wrapped by the thin paper material installed into the heating electronic device;
- dividing the sectional member in to at least one botanical section and the number of heated e-liquid segments wherein each of the heated segments comprising a sandwich structure that includes a porous fibrous sponge layer installed inside the base frame aluminum foil structure;
- filling the porous fibrous sponge layer of each heated segment by e-liquid, wherein the e-liquid holding capacity of each sponge layer is related to the porosity of the sponge and a set of settings of heating rate, heating duration and number of puffs;
- forming the heating electronic device with a longitudinal cavity from the top to the bottom part for the aerosol former product installation. Wherein an inner surface of the longitudinal cavity may include ring heating components connected to the power source and a control unit;
- adjusting the ring heating components to the botanical section and to each heating segment of the e-liquid section;
- heating the botanical section during all smoking sessions;
- heating the heated segments successively at the puff moment; and
- Starting heating each of the second heated segments before finishing a puff session of each first heated segment.

According to a preferred exemplary embodiment of the method, the porous fibrous sponge layer of heated segments is filled with e-liquid for one puff session wherein the puff session comprises at least three puffs.

The method may also include spacing structures that function as vapor permeable liquid-flow-inhibiting thermal barrier between heated segments of the e-liquid section of the sectional member.

The method may further include providing the heating duration of each heated section for a limited time to prevent a dry burn effect; heating one e-liquid section at a time to generate at least three puffs from each section. Wherein when heating the aerosol former product, one of the heated segments and the botanical section are heated simultaneously to different temperatures to minimize the formation of inhalable toxic chemical compounds from the botanical material.

According to the preferred embodiment, the method may include providing the botanical heating temperature less than 200 deg C., more preferably less than 150 deg C. and the e-liquid section heating temperature is less than 300 Deg C.

Providing the e-liquid volume of each heated section more than the heating duration of each puff session formed by the control unit.

According to preferred embodiment, the method may include providing a preheating of the heated segments with a temperature lower than e-liquid evaporation temperature.

One of the possible embodiments includes providing at least three vaping modes, wherein a first vaping mode is a botanical part mode, during which only the active ingredient (s) in the botanical is inhaled; a second vaping mode is a e-liquid part mode, during which only the e-liquid is vaporized as in an e-cigarette; and a third vaping mode is a mixing or hybrid mode, during which both the botanical active ingredients and the e-liquid are vaporized as in a hybrid heat not burn tobacco cigarette, The method may include providing the botanical smoking session duration equal to the common puff session duration of each e-liquid section.

Also the method may include detecting the product type when the inhalable aerosol former is inserted into the heater and carrying out the appropriate heating protocol upon device activation by the consumer.

According to the preferred embodiment of the invention, the method may include forming aerosol former products using mostly biodegradable materials and wherein non-biodegradable plastic materials are excluded. This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102*a*" or "102*b*", the letter character designations may differentiate two like parts or elements present in the same Figure. Letter character designations for reference numerals may be omitted when it is intended that a reference numeral to encompass all parts having the same reference numeral in all Figures.

DEFINED TERMS

Figure 1:
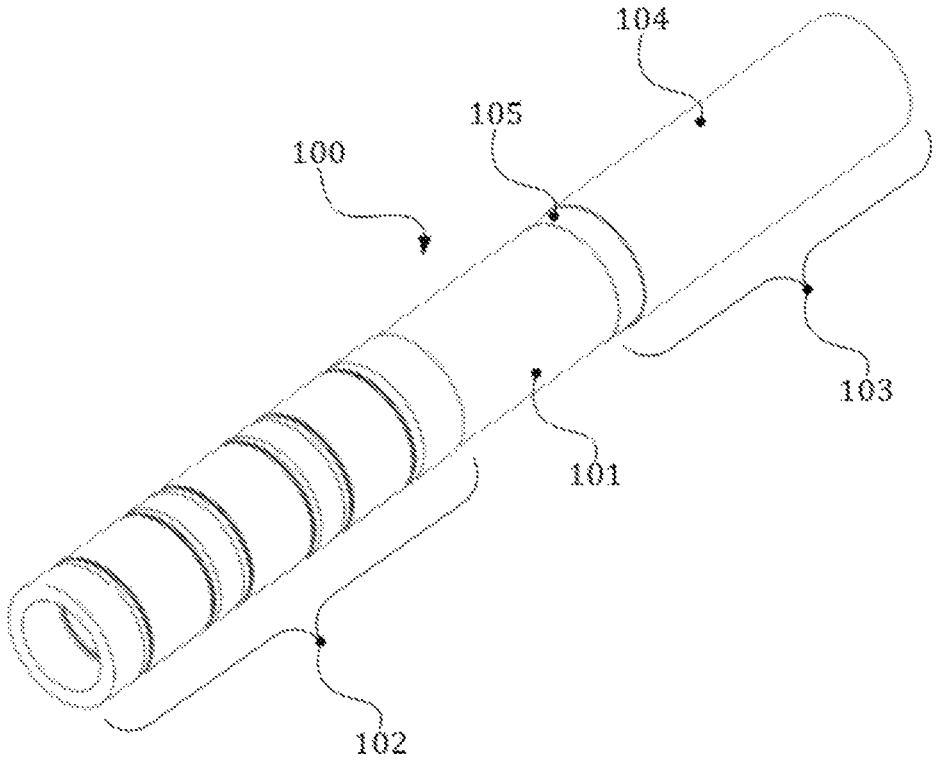
FIG. 1 illustrates a side perspective view of an aerosol former product.

While the invention is described in detail for a cylindrical shaped aerosol former in the shape and size of a "cigarette," it is subject to various modifications and alternative forms; specific embodiments thereof are shown by way of example in the drawings and the accompanying detailed description. It should be understood, however, that the drawings and detailed description are not intended to limit the invention to a particular embodiment which is described and/or illustrated in a particular figure. This disclosure is instead intended to cover all modifications, equivalents and alternatives falling within the scope of the this disclosure as understood by one of ordinary skill in the art.

As described herein, various exemplary embodiments of the invention comprise systems and methods for providing the aerosol former.

According to the present description, the given terms may have the following definitions:

Aerosol former—Includes both a single-use and disposable hybrid heat-not-burn or e-cigarette products.

Botanical section—The botanical section may comprise one or more of tobacco, hemp, *cannabis*, tea, mint, rose, menthol, jasmine, lotus leaf, licorice, vetiver, orange blossom, honey suckle, agilawood, *Sarcandra glabra, chrysanthemum*, codyceps *sinensis*, alfalfa, orange peel, dendrobium, rosemary, kratom, *ginseng*, rooibos, honeybush, and chestnut as pure solid material or a botanical-extract loaded on to a fibrous substrate. The botanical may also include synthetic or tobacco derived nicotine and nicotine salts. The extracts of the botanical may be loaded on to a cellulose substrate made by paper making process, or by air laying fibers followed by fiber entanglement using needle punching, hydroentanglement, stitch bonding, chemical bonding, or a combination of these.

The botanical extract may be loaded on to the substrate by dip coating, spray application, or by one of many types of printing processes. The botanical section is usually heated from its outside/external portion.

E-liquid section—an e-liquid loaded on a porous fibrous sponge is vaporized by outside heating to produce an inhalable vapor. The heated e-liquid segments may have the same or different flavoring compounds, synthetic or tobacco derived nicotine, one or many types of cannabinoids, or extracts of any botanical that are compatible with typical aerosol formers such as glycerin, propylene glycol and water mixtures. The e-liquid can be loaded onto the porous fibrous sponge during or after the manufacture of the fibrous sponge as described below.

A porous fibrous sponge layer—a highly porous cellulosic non-woven material filled with an e-liquid during or after the manufacture of the non-woven. The cellulose fiber used in the non-woven may be regenerated cellulose or preferably regenerated cellulose fiber doped during fiber spinning process with one or more of fire resistant additives such as silica, polysilicic acid, aluminum, phosphorus, and sulfur so as to minimize heat-induced discoloration of the sponge. The sponge may be hollow in the center with a minimum wall thickness of 2.0 mm.

The non-woven may be made by paper making process during which the e-liquid may be incorporated. Alternatively, the non-woven may be made by air laying fibers followed by fiber entanglement using needle punching, hydroentanglement, stitch bonding, chemical bonding, or a combination of these.

The porous sponge may be made from a pre-made non-woven by using cigarette paper filter making machine to form a pleated gathered web during which the porosity can be controlled. The e-liquid can be added during the non-woven gathering step by spray coating. Other fibers suitable for the sponge layer are carbon, and ceramic fibers that may be used alone or as mixtures with cellulose fibers.

Vapor permeable liquid-flow-inhibiting thermal barrier segment—a segment of the aerosol generating product installed between two series heated segments of e-liquid section with a botanical or another e-liquid segment that is made of nonwoven fabric produced from inherently hydrophobic regenerated cellulosic fibrous layer with very low porosity. This segment may also be referred to as a spacing structure relative to structures or elements positioned on either side of the spacing structure.

The entire spacing structure or vapor permeable liquid-flow-inhibiting thermal barrier segment can be made by using cigarette paper filter making machines such as Decoufle CU-10 or CU2OS available from Decoufle s.a.r.b. France, or modified rod forming apparatus available from Korber Technologies GmbH, Hamburg, Germany, to form a pleated gathered web during which the porosity can be controlled.

Heating rate—temperature increase per unit time for heating a botanical or e-liquid material up to the evaporation moment.

Heating duration—a time for evaporation of one heated segment of the section with a botanical or e-liquid material.

Heating electronic device—a specially designed heating device for an aerosol former according to the present invention.

Ring heating component—a part of the specially designed heating device formed by at least two half ring heating elements installed within the body parts of the heating electronic device.

A puff session—a use period of the aerosol former product comprising at least three puffs.

First vaping mode—is a botanical part mode when the botanical section is heated only, during which only one or more active ingredients of the botanical is vaporized.

Second vaping mode—is an e-liquid part mode when the e-liquid section is heated only, during which aerosol former is vaporized as in an e-cigarette.

Third vaping mode—is a mixing mode when the e-liquid section and the botanical section are heated simultaneously, as in a heat-not-burn tobacco cigarette.

Botanical smoking session duration—a time for total puff session duration of each heated segment of e-liquid section.

Botanical material—one or more of tobacco, hemp, *cannabis*, tea, mint, rose, menthol, jasmine, lotus leaf, licorice, vetiver, orange blossom, honey suckle, agilawood, *Sarcandra glabra, chrysanthemum*, codyceps *sinensis*, alfalfa, orange peel, dendrobium, rosemary, kratom, *ginseng*, rooibos, honeybush, and chestnut or any combination of these as solid material or in extract form.

Heating protocol—a heating electronic device program instruction for each type of aerosol former.

Biodegradable materials—environmentally friendly materials used for the production of aerosol former excluding metal foil.

DETAILED DESCRIPTION OF EXEMPLARY EMBODIMENTS

In the below described exemplary embodiments of an aerosol source member according to the present disclosure uses electrical energy to heat a material to form an inhalable substance (e.g., electrically heated botanical products). The material may be heated without combusting the material to any significant degree. Components of such systems have the form of articles that are sufficiently compact to be considered single use disposable cigarettes. That is, use of components of aerosol formers does not result in the production of smoke in the sense that aerosol results principally from by-products of combustion or pyrolysis of botanical material, but rather, use of those systems results in the production of vapors resulting from volatilization or vaporization of certain components incorporated therein. In some example embodiments, components of aerosol formers may be characterized as electronic cigarettes. Some electronic cigarettes may incorporate botanical and/or components derived from botanical material, and hence deliver botanical derived components in aerosol form.

While the systems are generally described herein in terms of embodiments associated with aerosol formers and/or aerosol source members such as so-called "e-cigarettes" or "tobacco heating products," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol formers by way of example only and may be embodied and used in various other products and methods.

Aerosol delivery devices and/or aerosol source members of the present disclosure may also be characterized as being vapor-producing articles or medicament delivery articles. Thus, such articles or devices may be adapted to provide one or more substances (e.g., flavors and/or pharmaceutical active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered smoke-like. The physical form of the inhalable substance is not necessarily limited by the nature of the inventive devices but rather may depend upon the nature of the medium and the inhalable substance itself as to whether it exists in a vapor state or an aerosol state. In some embodiments, the terms "vapor" and "aerosol" may be interchangeable. Thus, for simplicity, the terms "vapor" and "aerosol" as used to describe aspects of the disclosure are understood to be interchangeable unless stated otherwise.

Although an aerosol former and/or an aerosol source member according to the present disclosure may take on a variety of embodiments, as discussed in detail below, the use of the aerosol former and/or aerosol source member by a consumer will be similar in scope. The foregoing description of use of the aerosol delivery device and/or aerosol source member is applicable to the various embodiments described through minor modifications, which are apparent to one of ordinary skill in the art in light of the further disclosure provided herein. The description of use, however, is not intended to limit the use of the articles of the present disclosure but is provided to comply with all necessary requirements of disclosure herein.

More specific formats, configurations, and arrangements of various substrate materials, aerosol source members, and components within aerosol former of the present disclosure will be evident considering the further disclosure provided hereinafter. Additionally, the selection of various aerosol former components may be appreciated upon consideration of the commercially available electronic aerosol formers. Further, the arrangement of the components within the aerosol delivery device may also be appreciated upon consideration of the commercially available electronic aerosol formers.

The term "exemplary" is used herein to mean "serving as an example, instance, or illustration." Any aspect described herein as "exemplary" is not necessarily to be construed as preferred or advantageous over other aspects. Referring now to the drawings, wherein the showings are for purposes of illustrating certain exemplary embodiments of the present disclosure only, and not for purposes of limiting the same, FIG. 1 illustrates a hybrid heat-not-burn product 100 which is substantially designed as an aerosol former product 100. In the depicted embodiment, the aerosol former 100 is designed as a sectional stick wrapped by a thin paper material 107 or a polymeric fiber wrap 107 (see FIGS. 2*a*-2*c*) that is of sufficient thickness to maintain structural integrity of the aerosol former 100. Said sectional stick can be designed as a cylindrical or other shaped structure. The sectional stick comprises at least one botanical section 101 connected to several e-liquid sections 102. Said e-liquid sections 102 and at least one botanical section 101 are connected in series with a mouthpiece section 103. The mouthpiece section 103 is formed by a cooling segment 104 and a filter segment 105. The filter segment 104 may comprise two or more different segments wrapped by using (or not using) foil-paper. The sectional member 100 is generally hollow in the e-liquid section 102 and the cooling segment 104, and it is optionally hollow in the filter segment 105 and in the botanical section 101. The cross-sectional shape of the hollow sections can be one of circular, triangular, square, or multilobe or irregular in cross section.

The number of e-liquid sections 102 is usually at least two. That is, the e-liquid section 102 may comprise at least two separate sections wherein each of the e-liquid section volume is designed for at least three puffs. Each section of the e-liquid section 102 can be filled with an e-liquid of the same or different compositions. The e-liquid composition may include, but is not limited to, substances that comprise at least one of glycerin, water, propylene glycol, nicotine, nicotine salts, cannabinoids, and one or more flavoring compounds loaded onto a porous medium of a sponge layer. Each of the e-liquid heated sections 102 and at least one botanical section 101 are generally heated separately.

Figure 2A:
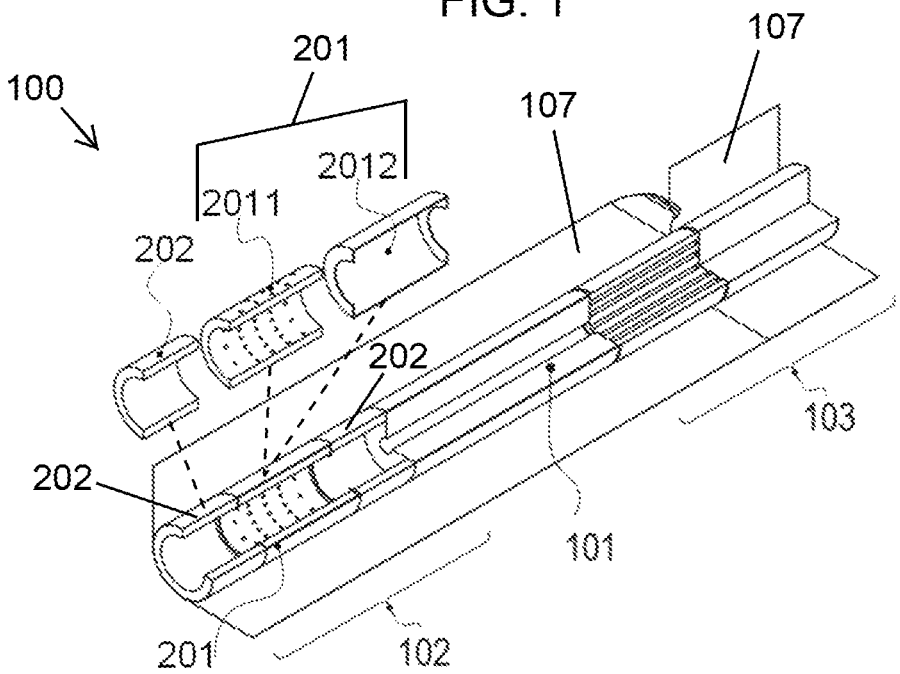
FIG. 2*a* illustrates a perspective cross sectional view of the aerosol former product (first exemplary embodiment)
Figure 2B:
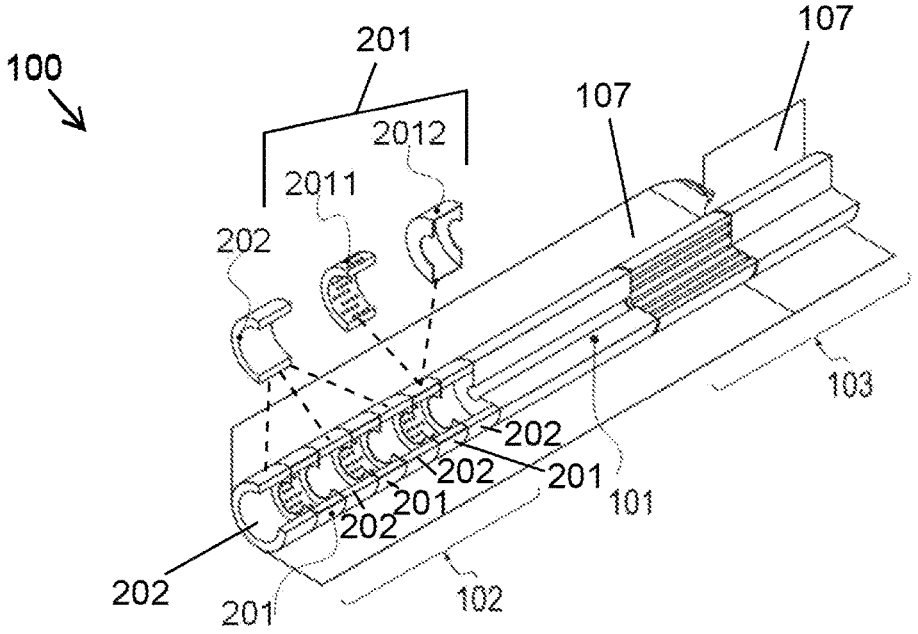
FIG. 2*b* illustrates a perspective cross sectional view of the aerosol former product (second exemplary embodiment)
Figure 2C:
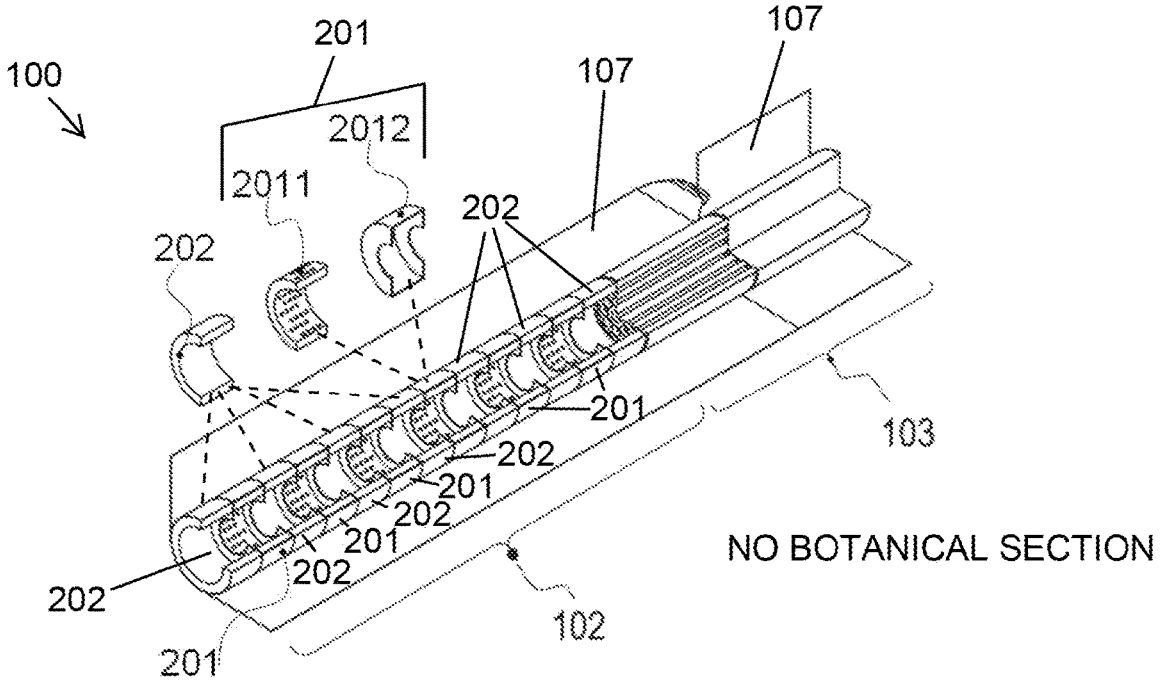
FIG. 2*c* illustrates a perspective cross sectional view of the aerosol former product (third exemplary embodiment)

FIGS. 2*a*; 2*b*; and 2*c* illustrate perspective cross sectional views of variants of heat-not burn tobacco aerosol formers 100 with e-liquid and botanical segments and without a botanical segment respectively, wherein each of the e-liquid sections 102 may include a heated segment 201 and a vapor permeable liquid-flow-inhibiting thermal barrier 202. Each of the heated segments 201 may comprise a sandwich structure consisting of a porous fibrous sponge layer 2011 made as pleated gathered web of cellulose fiber based porous non-woven fabric or paper installed adjacent to a base frame aluminum foil structure 2012. FIG. 2*a* shows the e-liquid section 102 to include one heated segment 201 and two vapor permeable liquid-flow-inhibiting thermal barriers 202 or also referred to as spacing structures 202 relative to the single heated segment. Shown with two dashed lines above the single heated segment 201 as an exploded parts view, the porous fibrous sponge layer 2011 and aluminum foil structure 2012 are depicted separate from one another. Meanwhile, shown with a single dashed line above the last or end thermal barrier 202 or spacing structure 202, is another view of the thermal barrier 202 shown adjacent to the sponge layer 2011. Referring now to FIG. 2*b*, this figure illustrates the e-liquid section 102 to include four thermal barriers 202 or spacing structures 202 interposed or positioned between three heated segments 201. Like FIG. 2*a*, an exploded parts view of these structures are shown above them using dashed lines. And referring now to FIG. 2*c*, this figure shows a corresponding E-cigarette version with seven thermal barriers 202 and six heated sections 201, and where the botanical section 101 is absent/not present in this exemplary embodiment. This means the last thermal barrier 201 within the aerosol former 100 of FIG. 2*c* is adjacent to the filter segment 105 of the mouthpiece 103. According to another exemplary embodiment (not illustrated) and opposite to FIG. 2*c*, the e-liquid section 102 could be removed completely while a botanical section 101 is provided adjacent to the mouthpiece 103. That is, referring back to FIG. 2*b*, the e-liquid section 102 could be removed completely while only the botanical section 101 and mouthpiece 103 remain. Referring back to FIGS. 2*a*-2*c*, all three figures show the paper foil 2012 (not metal-paper foil) adjacent to the porous fibrous sponge layer 2011, where the sponge layer 2011 fits inside the concave volume/space defined by the geometry of the foil structure 2012.

Figure 3:
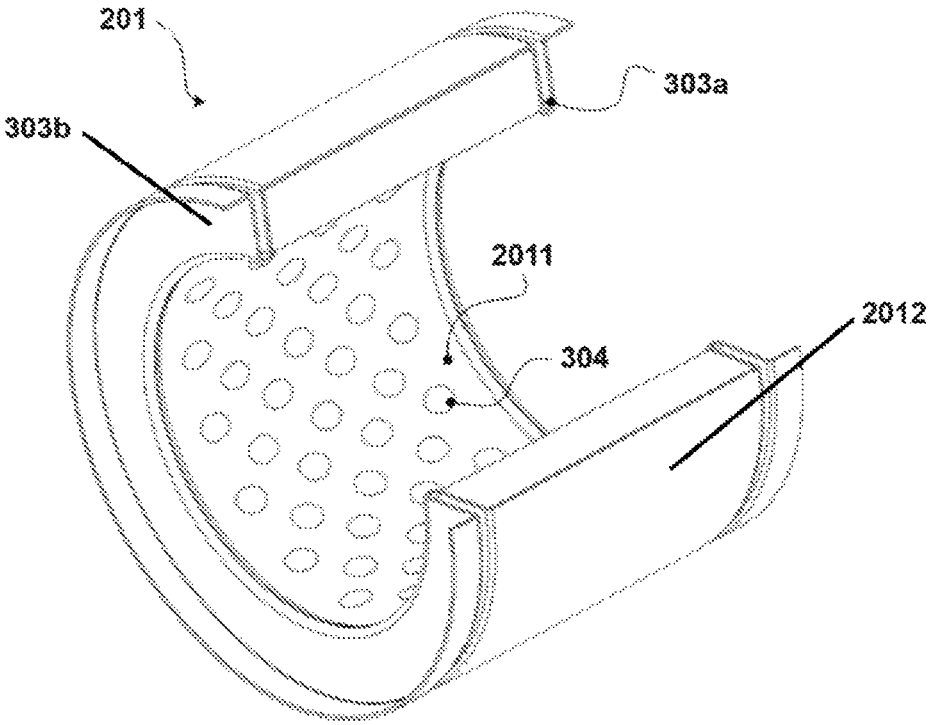
FIG. 3 illustrates a heated segment using a perspective cross sectional view.

Each of the heated segments 201, as illustrated in detail in FIG. 3, may comprise a sandwich structure that includes a porous fibrous sponge layer 2011 made of cellulose fiber based non-woven fabric or paper installed inside a base frame aluminum foil structure 2012. The sponge layer 2011 may comprise pores or openings 304.

The sponge layer 2011 may be positioned between two stiffener barriers 303*a*, 303*b*. The stiffener barriers 303 may be formed as a pressed stamping on the inner surface of the base frame aluminum foil structure 2012. The sponge layer 2011 may be designed by a recessed filter technology in combination with pleated and gathered webs capable of holding e-liquids. The e-liquid is loaded during pleating and or gathering of the non-woven as when making paper filters. Alternatively, the e-liquid may be added to the non-woven during its manufacture by paper-making process. High e-liquid holding capacities are preferred but the maximum loading level is such that e-liquid leakage during the product storage is prevented.

Within the e-liquid section 102 and between the botanical section 101 and e-liquid section are vapor permeable liquid-flow-inhibiting thermal barrier segments 202, also referred to as spacer structures 202. The thermal barrier segments or spacer structures 202 installed between the e-liquid segments 102 may comprise a non-woven fabric made of an inherently hydrophobic regenerated cellulose fiber, such as the *Olea* fiber available from Kelheim fibers GmbH of Bavaria, Germany. The thermal barriers 202 are usually hard and non-porous so that e-liquid leakage from the adjacent segment may be prevented, especially during storage of the aerosol former 100.

Figure 4A:
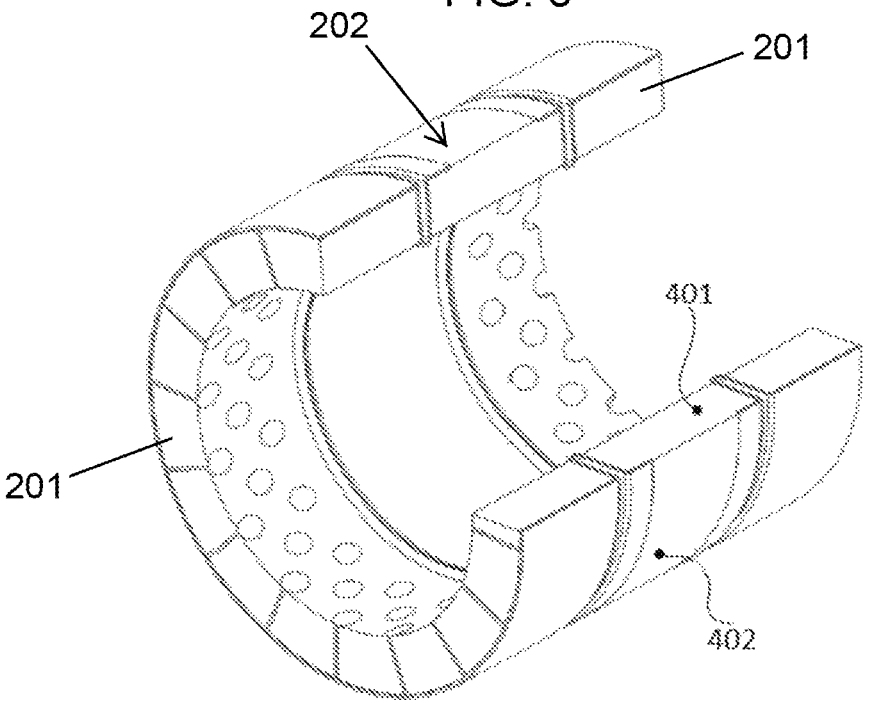
FIG. 4*a* illustrates a vapor permeable liquid-flow-inhibiting thermal barrier segment of a first exemplary embodiment using a perspective cross sectional view.
Figure 4B:
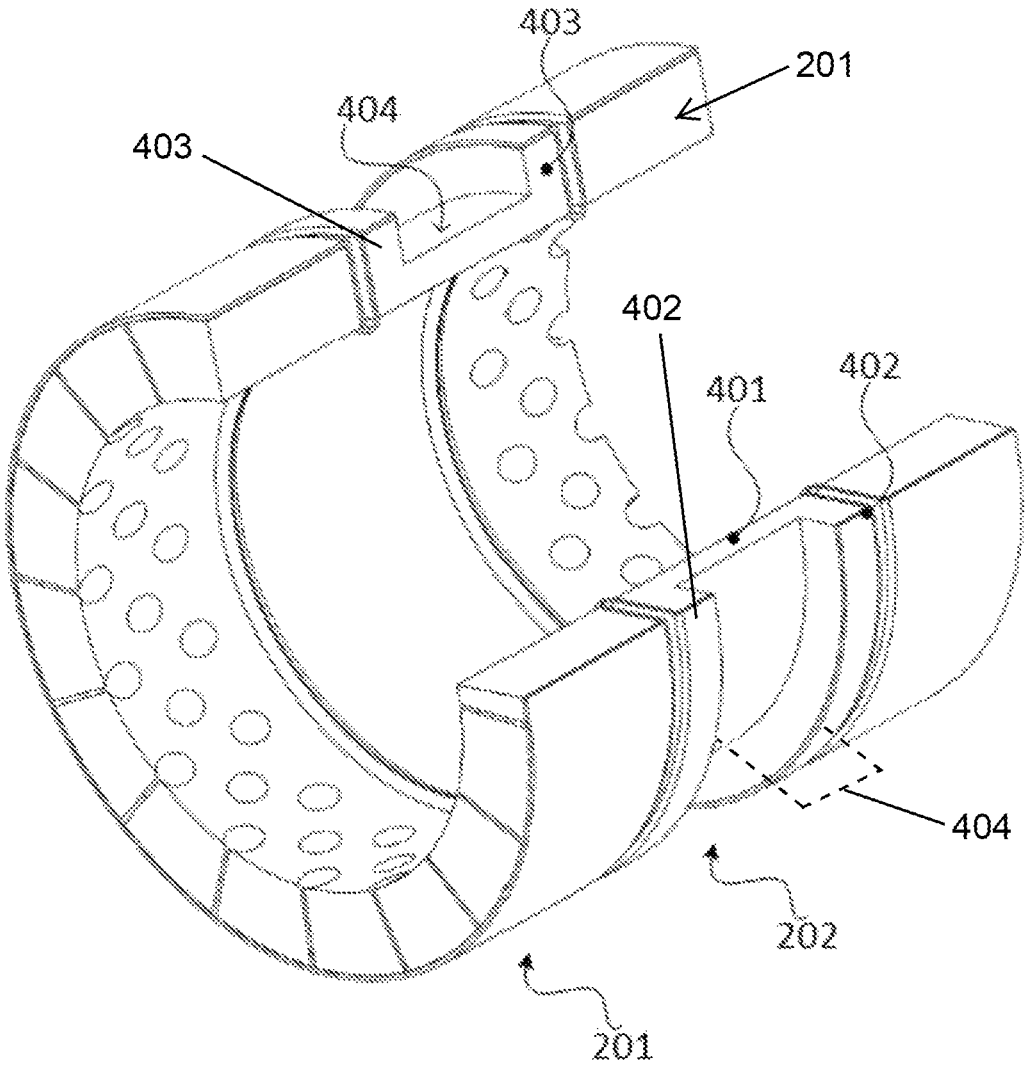
FIG. 4*b* illustrates a vapor permeable liquid-flow-inhibiting thermal barrier segment of a second exemplary embodiment using a cross sectional view.

The thermal barrier segments or spacer structures 202 are further illustrated in FIG. 4*a* and in FIG. 4*b*.

FIG. 4*a* illustrates a cross sectional view of a thermal barrier segment 202 of a first exemplary embodiment disposed between two heated segments 201. The thermal barrier segment 202 may comprise a base frame hard non-porous fibrous structure 401 with a limiting surface barrier 402. In the first exemplary embodiment shown in FIG. 4*a*, the limiting surface barrier 402 may be formed by a paper or polymer material layer. Said paper or polymer material layer 402 may be positioned in the central part/portion of the outer cylindrical surface of the thermal barrier segment 202.

According to another exemplary embodiment of the thermal barrier segment/spacer structure 202 as illustrated in FIG. 4*b*, the limiting surface barrier 402 is positioned on a surface of two flanges 403 that are part of the base frame hard non-porous fibrous structure 401. With the structure illustrated in FIGS. 4*a*-4*b*, the heated segments 201 are separated by a vapor permeable liquid-flow-inhibiting thermal barrier 202 which (as shown in FIG. 4*b*) has an air gap 404 disposed between the two flanges 403 of the fibrous structure 401. When the vapor permeable liquid-flow-inhibiting thermal barrier 202 has a length dimension (that is parallel to the central axis of the cylindrical geometry shown in FIG. 4*a*; 4*b*) of at least 5.0 mm, such a magnitude in its length ensures low heat dissipation between the heated segments 201. Some dimensions for the e-cigarette, circumference, and a length can be as follows: overall length between about 45.0 to about 84.0 mm; a diameter between about 5.0 to about 7.0 mm. Wherein the e-liquid section 102 and the botanical section 101 and the mouthpiece section 103 are wrapped with a paper or polymeric fiber wrap 107 that is of sufficient thickness to maintain structural integrity of the heat-not burn product 100/aerosol former product 100.

According to one exemplary embodiment of the invention, the heat-not-burn product 100/E-cigarette 100 are formed using biodegradable materials excluding metal foil. Non-biodegradable plastic materials are excluded. All used materials may be recyclable. The e-liquid section 102, the botanical section 101, the mouthpiece section 103 (that includes the cooling segment 104 and the filter segment 105), may be produced separately and assembled into a single structure.

The described aerosol formers 100 may be used in combination with a specially designed heating device 500.

Figure 5A:
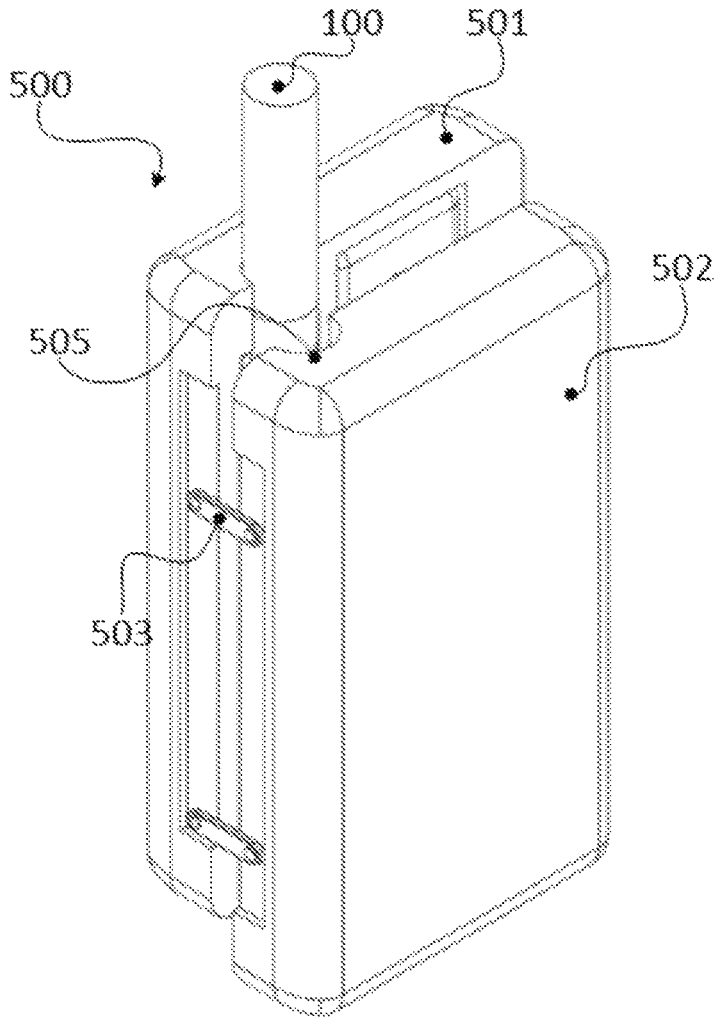
FIG. 5*a* illustrates a perspective view of a heating electronic device according to a first exemplary embodiment.
Figure 5B:
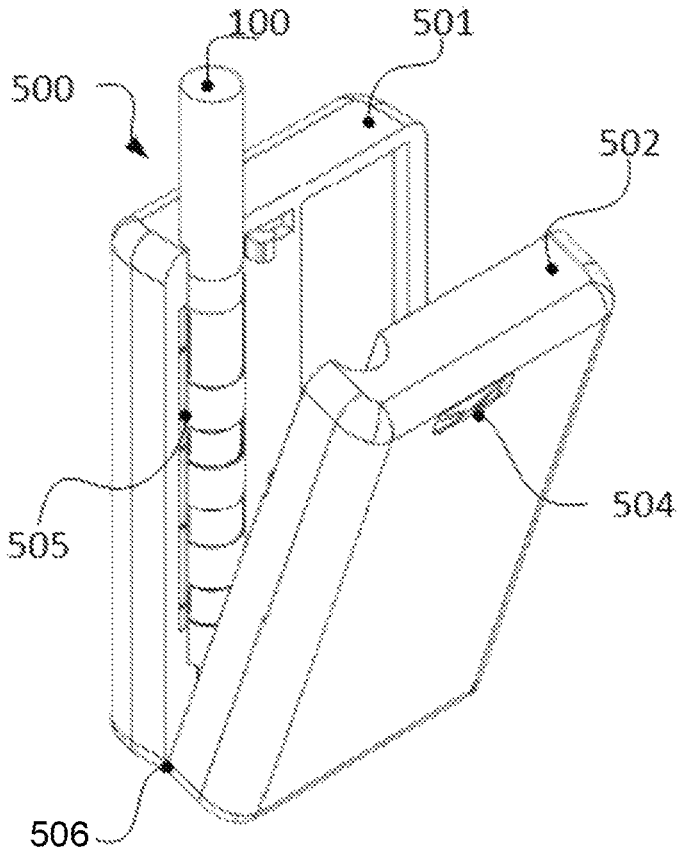
FIG. 5*b* illustrates a perspective view of a heating electronic device according to a second exemplary embodiment.

Two exemplary embodiments of the heating device 500 are illustrated in FIGS. 5*a* & 5*b*. FIG. 5*a* illustrates a heating device 500 comprising a body part 501 and a cover part 502 connected to each other by a slider coupling 503. The body part 501 and the cover part 502 may be locked together by a slider lock 504 in a top portion of the cover part 502 (see FIG. 5*b* for the slider lock 504). The body part 501 and the cover part 502 may form together a longitudinal cavity 505 from a top portion of the body part 501 and top portion of the cover 502 to the bottom part of the device 500. The longitudinal cavity 505 is designed to receive the aerosol former product 100 prior to heating.

Figure 6:
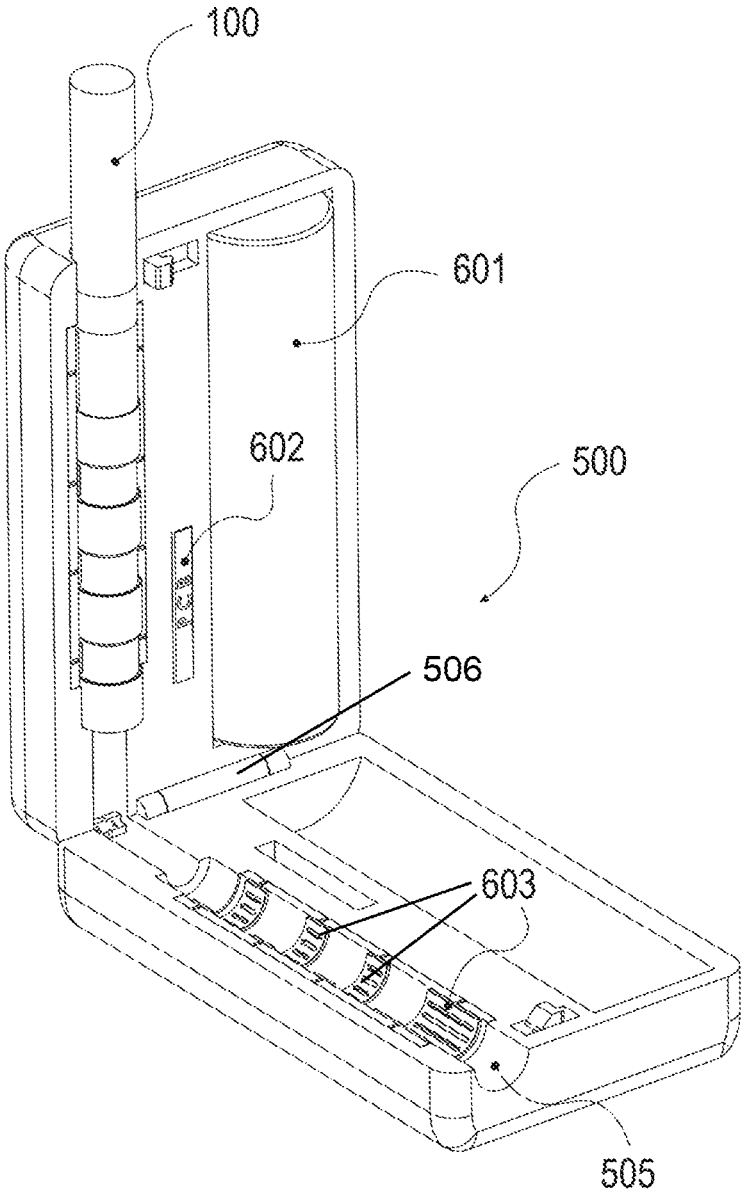
FIG. 6 illustrates a perspective view of a heating electronic device which has been opened.

The inner surface of the longitudinal cavity 505 is illustrated in FIG. 6 where the heating device 500 in this exemplary embodiment may be opened slightly along a hinged portion 506. As shown in FIG. 5*b*, the longitudinal cavity 505 may include ring-shaped heating components 603. The heating components 603 may be connected to a power source 601 (i.e. a battery, a capacitor, an electric storage device, and/or a combination thereof, etc.) and a control unit 602 (as illustrated in FIG. 6). The heating components 603 may comprise nichrome or iron-chromium-aluminum (FeCrAl) alloys, or a combination thereof. Each heating component 603 may comprise a half-ring/semi-ring-shaped plate located on as surface of the body part 501 and a surface of the cover part 502 and within the longitudinal cavity 505 area as illustrated in FIG. 6. The heating components 603 can be designed as: resistance, inductive, solid-state microwave, infrared and non-electrical heating such as using a carbon heat source.

According to the described system, the heating component semi-ring-shaped plates 603 are aligned with the botanical section 101 and with each heated segment 201 of the e-liquid section 102 when the aerosol former product 100 is positioned within the heating device 500 while the heating device 500 is open as illustrated in FIGS. 5*b*-6.

The opened heating device 500 allows the installation and positioning of the aerosol former product 100 within the heating device 500. The design of the heating device 500 is to prevent damage or destruction to the aerosol former product 100. The aerosol former product 100 is positioned by sliding it into the heating device along its longitudinal axis of its cylindrical geometry. The closed position of the body parts of the heating device 500 protects the aerosol former product 100 and provides a tight fit with the heating components 603. Specifically, the semi/half-ring shaped plates 603 are aligned with the heated segments 201 of the e-liquid section 102 and botanical section 101 when the aerosol former 100 is positioned within the heating device 500. During a smoking session in which a user inhales using the mouthpiece 103 of the aerosol former 100, the aerosol former 100 remains within the heating device 500, and specifically, within the longitudinal cavity 505.

Each of the heating components 603 is configured to heat a related heated segment 201 successively. The heating components are positioned in close contact with the botanical section 101 and each heated segment 201 of the e-liquid sections 102. The heating device 500 and/or the e-cigarette 100 substantially can be equipped with ventilation system for improving the heating device efficiency.

The control unit 602 of the heating device 500 is configured to provide heating duration related to a preset/predetermined number of puffs for each e-liquid section 102. The control unit 602 may comprise a central processing unit (CPU), a digital signal processor (DSP), as well as memory (including volatile and/or non-volatile memory types not illustrated), and/or any combination/number of discrete circuit components to form a digital/computing logic as understood by one of ordinary skill in the art. A capacity of each e-liquid section 102 is related to porosity and a set/predetermined heating rate and heating duration are determined by the control unit 602. The control unit 602 is designed so that the heating device 500 provides sufficient heating based on the method for providing a aerosol former product 100.

According to one exemplary embodiment, the method comprises the steps of: forming the system for the aerosol former product 100 that includes a sectional cylindrical stick/structure wrapped by thin paper material that is positioned within a electronic heating device 500. According to the described method, the sectional cylindrical stick 100 is divided into at least one botanical section 101 and a number of e-liquid sections 102. The present sectional cylindrical structure of the aerosol former 100 allows the filling of each sponge layer of each heated segment 201 of an e-liquid section 102.

The method for providing the aerosol former product 100 may include providing the e-liquid capacity of each sponge layer of the heated segments 201 depending on the settings of the heating rate, the heating duration, and the number of puffs desired. Based on one or more of these three settings, filling the sponge layer of heated segments 201 by e-liquid for one puff session wherein the puff session comprises at least three puffs. With determining the length of a puff session (i.e. at least three puffs), a heating duration of each heated section may be calculated by the control unit 602 for a limited period of time in order to prevent a dry burn effect. Also, by providing the e-liquid volume for each heated segment in addition to the desired puff session, the control unit 602 may take these two parameters into account (as well as others) in order to determine the heat duration and sequence (i.e. order of heating) for each heated section 201 that is in contact with a particular half-ring shaped heater component 603. That is, each half-ring shaped heater component 603 contacting a single heated section 201 and/or botanical section 101 of aerosol former product 100 may each have its own temperature setting (i.e. desired specific temperature) and/or its own duration (time) of heating as understood by one of ordinary skill in the art Another step of the present method is forming the heating electronic device 500 with the longitudinal cavity 505 from the top to the bottom part for installation of the aerosol former product 100. According to another exemplary embodiment of the electronic heating device 500, the inner surface of the longitudinal cavity 505 that includes the heating components formed as semi-ring-shaped plates 603 may be coupled to the power source 601 and the control unit 602.

The heating device 500 allows the ring heating components 603 to be heated separately and individually such that the botanical section 101 and each heating segment 201 of the e-liquid section 101 may be heated for different durations and/or at different desired temperatures. Such a design improves the surface heating of the aerosol former product 100 compared to those known in the prior art. As noted previously, during a smoking session in which a user inhales using the mouthpiece 103 of the aerosol former 100 after the former 100 has been heated, the aerosol former 100 remains within the heating device 500, and specifically, within the longitudinal cavity 505 during the smoking session.

According to one exemplary method, the heating process of the aerosol former product 100 positioned within the heating device 500 is calculated by a heating period of the botanical section 101 which occurs during the entire/whole smoking session and a heating period of each heated segment 201 of the e-liquid sections 102 which are successively heated during the entire/whole smoking session. This means each of a second heated segment 201 of the e-liquid section 102 is heated before finishing a puff session of each first heated segment 201 of the e-liquid section. This successive heating of segments 201 leads to preheating of each second heated segment 201 of the e-liquid sections 102. The botanical smoking session duration is equal to the common puff session duration of each heated segment of the e-liquid section 102.

In order to prevent formation of inhalable toxicants from the botanical material in section 101, the e-liquid sections 102 and the botanical section 101 may be simultaneously heated to different temperatures. In this case, the temperature of each heated segment 201 will be higher than the temperature of the botanical section 101. According to one exemplary embodiment, the botanical section 101 may be heated with the electronic heating device 500 to less than 200.0 Deg. C., more preferably to less than 150.0 Deg C., while the e-liquid section 102, and its heated segments 201, are heated to less than 300.00 Deg. C.

According to one exemplary embodiment, the botanical section 101 is heated depending on the type of botanical material within the section 101 and to a temperature such that its active ingredient formation is maximized while formation of temperature induced thermal degradation is minimized. The system, that includes the aerosol former 100 and heating device 500, is also designed for detecting the botanical material type within the botanical section 101 when positioned within the heating device 500 and carrying out heating the botanical section 101 at an appropriate heating temperature for the detected botanical material type by the control unit 602. Also, according to another alternative exemplary embodiment, the user of the heating device 500 can set the heating temperature with the control unit 602 depending on the botanical material type known by the user to be present within the botanical section 101.

For increasing the battery life of the heating device 500, the heating device 500 may preheat the heated segments 201 of the e-liquid section 102 with one or more temperatures lower than an e-liquid evaporation temperature for the e-liquid present within each heated segment 201. Then, the heating device 500 may activate the full capacity of the power source 601 during each puff of the aerosol former product 100.

According to another exemplary embodiment, the control unit 602 may provide at least three vaping modes: wherein the first vaping mode is a botanical part mode; a second vaping mode is an e-liquid part mode; and a third vaping mode is a mixing mode. The user of the heating device 500 can change modes for choosing a type of vaping product.

The system and method may detect the type of material within the botanical segment 101 when the inhalable aerosol former 100 is inserted into the heating device 500 and then it may proceed with an appropriate heating protocol when the heating device 500 is activated by the user for heating the aerosol former 100. This detection by the control unit 602 of the heating device may be achieved by using one or more sensors (not shown—but include, for example, optical sensors for reading markers on the aerosol former 100 surface that indicate material types) which are installed into the device longitudinal cavity 505 (not shown). The system according to an exemplary embodiment may be equipped where the aerosol former 100 has color changing indicators on its sections 101, 102, 103 to indicate that: the botanical section 101 has been heated; the heating temperature of the botanical section 101 has not been exceeded; or a color change may indicate the aerosol former product 100 has been used (i.e. is done/has no more puffs available); or change one or more colors in the sections 101, 102, 103 in order to indicate a brand of the aerosol former product 100. Having described various steps of the method above, it is understood that certain steps in the exemplary method naturally precede others for the system (that includes the aerosol former 100 and/or heating device 500) to function as described. However, the inventive system is not limited to the order of the steps described if such order or sequence does not alter the functionality of the system and method of the present disclosure. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

One of the important features of the inventive system is its environmentally friendly nature. Accordingly, the aerosol former product 100 may be formed by mostly biodegradable materials, while non-biodegradable plastic materials are excluded from its make-up. The sectional structure of the aerosol former product 100 allows it to be effectively recycled. Alternative exemplary embodiments for the system and method of the present disclosure will become apparent to one of ordinary skill in the art to which the invention pertains without departing from the scope of this disclosure. For example, as mentioned above, according to another exemplary embodiment (not illustrated) and opposite to FIG. 2*c*, the e-liquid section 102 could be removed completely while a botanical section 101 is provided adjacent to the mouthpiece 103. That is, referring back briefly to FIG. 2*b*, the e-liquid section 102 could be removed completely while only the botanical section 101 and mouthpiece 103 remain for another version of the aerosol former product 100.

In light of the above discussion, other variations/exemplary embodiments are possible and are included in this disclosure as understood by one of ordinary skill in the art. Therefore, although selected aspects have been illustrated and described in detail above, it will be understood that various substitutions and alterations relative to the text and/or drawings may be made without departing from the scope and spirit of this disclosure, as defined by the following claims.

What is claimed is:

1. A biodegradable aerosol former for heat-not-burn and e-cigarettes comprising:

a sectional member wrapped by a paper material positioned within a heating device, the sectional member comprising a plurality of cylindrical sections and a cylindrical mouthpiece section, wherein at least one a first cylindrical section of the sectional member is a botanical section, and a second cylindrical section is an e-liquid section coupled to a first end of the first cylindrical section; the cylindrical mouthpiece section being coupled to a second end of the first cylindrical section; wherein the cylindrical sections of the sectional member are heated by a heating component of the heating device;

the e-liquid section comprises a cylindrical heated segment and two cylindrical vapor permeable liquid-flow-inhibiting thermal barriers, where the cylindrical heated segment is positioned between the two cylindrical vapor permeable liquid-flow-inhibiting thermal barriers, the heated segment comprises a cylindrical sandwich structure comprising a cylindrical porous fibrous sponge layer made from a cellulose fiber based non-woven material installed inside a cylindrical base frame aluminum foil structure, wherein the cylindrical porous fibrous sponge layer in the heated segment is filled with an e-liquid during or after manufacture of the cylindrical porous fibrous sponge layer, an amount of e-liquid in the porous fibrous sponge layer being directly related to the porosity of the cylindrical porous fibrous sponge and calibrated to a desired heating rate and heating duration, wherein each vapor permeable liquid-flow-inhibiting thermal barrier comprises a first layer of a hard non-porous hydrophobic non-woven fiber, and a second layer of a hydrophobic cellulose fiber on an external surface of the first layer, the second layer forming a limiting surface barrier for the first layer.

2. The aerosol former according to claim 1, wherein the cylindrical heated segment is made from one of cellulose, carbon, glass, ceramic fibers, or mixtures thereof, wherein each e-liquid section comprises at least two separate heated segments and wherein each of the heated segments is designed for at least two puffs.

3. The aerosol former according to claim 1, wherein the botanical section is formed from at least one of: beads, strips, shredded pieces, granules, gathered webs, or any combination thereof, wherein the botanical section comprises one or more of: tobacco, hemp, *cannabis*, tea, mint, rose, menthol, jasmine, lotus leaf, licorice, vetiver, orange blossom, honey suckle, agilawood, *Sarcandra glabra, chrysanthemum*, codyceps *sinensis*, alfalfa, orange peel, dendrobium, rosemary, kratom, *ginseng*, rooibos, honeybush, and chestnut, or any combination thereof.

4. The aerosol former according to claim 3, wherein a botanical extract of the botanical section is loaded on to a cellulose substrate made by a paper making process, or by a fiber air laying process followed by fiber entanglement using needle punching, hydroentanglement, stitch bonding, chemical bonding, or any combination thereof, wherein the botanical extract is loaded on to the substrate by dip coating, spray application, or a printing process.

5. The aerosol former product according to claim 1, wherein each cylindrical vapor permeable liquid-flow-inhibiting thermal barrier has a length between about 2.0 mm and about 10.0 mm.

6. The aerosol former according to claim 1, wherein the sectional member has a length between about 45.0 mm and about 84.0 mm, and diameter between about 3.0 mm and about 8.0 mm.

7. The aerosol former according to claim 1, wherein the sectional member is hollow in the e-liquid section, and has a cooling section and a filter section.

8. The aerosol former according to claim 1, wherein the sectional member comprises at least two heated sections, and wherein the botanical section is heated separately to a first temperature of between about 150.0 and about 250.0 deg C., while the e-liquid section is heated separately to a second temperature of about 300.0 deg C. or less.

9. The aerosol former according to claim 1, wherein the botanical section is heated depending on the botanical type to a temperature such that an active ingredient of the botanical section is activated without significant heat-induced chemical degradation.

10. The aerosol former according to claim 1, wherein the e-liquid section, the botanical section, and the cylindrical mouthpiece section are wrapped with a paper or polymeric fiber wrap that is of sufficient thickness to maintain structural integrity the aerosol former.

* * * * *